US005639584A

United States Patent [19]

Anno et al.

[11] Patent Number: 5,639,584

[45] Date of Patent: Jun. 17, 1997

[54] TONER FOR DEVELOPING ELECTROSTATIC LATENT IMAGES

[75] Inventors: Masahiro Anno, Sakai; Makoto Kobayashi, Settsu, both of Japan

[73] Assignee: Minolta Camera Kabushiki Kaisha, Osaka, Japan

[21] Appl. No.: 297,904

[22] Filed: Aug. 29, 1994

Related U.S. Application Data

[62] Division of Ser. No. 66,653, May 25, 1993, abandoned.

[30] Foreign Application Priority Data

May 29, 1992 [JP] Japan ..... 4-138504
May 29, 1992 [JP] Japan ..... 4-138509

[51] Int. Cl.[6] ..... G03G 9/08

[52] U.S. Cl. ..... 430/437; 430/109

[58] Field of Search ..... 430/137, 109

[56] References Cited

U.S. PATENT DOCUMENTS 4,835,082 5/1989 Koishi et al. .
4,839,255 6/1989 Hyosu et al. .
4,902,596 2/1990 Koishi et al. .
4,923,776 5/1990 Hedvall et al. ..... 430/137
4,933,253 6/1990 Aoki et al. .
5,066,558 11/1991 Hikake et al. .
5,080,992 1/1992 Mori et al. .
5,085,963 2/1992 Suzuki et al. .
5,120,631 6/1992 Kanbayashi et al. ..... 430/111
5,290,654 3/1994 Sacripante et al. ..... 430/137
5,328,795 7/1994 Yamashiro et al. ..... 430/137

OTHER PUBLICATIONS

English translation of JP 63-104658 May 1988.

*Primary Examiner*—Christopher D. RoDee
*Attorney, Agent, or Firm*—Burns, Doane, Swecker & Mathis, LLP

[57] ABSTRACT

The present invention provides a toner for developing electrostatic latent images prepared by the following processes comprising;

a process (a) of forming particles for toner containing at least a resin and a coloring agent in a wet process, a process (b) of aggregating the particles, and a process (c) of the aggregates passing through a minimal gap of 0.5–10 mm under dispersed conditions in air-stream flowing at a high speed to pulverize the aggregates, the gap being formed between a rotator and a rotator or between a rotator and a stator.

12 Claims, 1 Drawing Sheet

TONER FOR DEVELOPING ELECTROSTATIC LATENT IMAGES

This application is a divisional of application Ser. No. 08/066,653, filed May 25, 1993, now abandoned.

BACKGROUND OF THE INVENTION

The present invention relates to a toner for developing electrostatic latent images, in particular a toner prepared by granulating particles in wet process, aggregating and pulverizing the particles.

Copy images of high quality have been required in the field of a copy machine or printer for electrophotography. In order to meet the requirements, it has been researched and investigated to make toner particles small.

A pulverizing method has been conventionally used as a production method of toner. The pulverizing method is carried out by melting and kneading binder resins and coloring materials and then pulverizing and classifying the kneaded materials.

Toner particles obtained by the pulverizing method, however, have broad distribution of particles size of toner. The limitations from technical view points and productivity such as yield are imposed on the pulverizing method.

Wet granulating methods such as a suspension polymerization method and a suspension granulating method are known as a method which can be applied to make toner particles small and more useful than the pulverizing method from the viewpoint of productivity. By the suspension polymerization method, polymerizable monomers, coloring materials and other additives are added to be granulated to give toner particles synthesized in suspension. Such wet granulating methods can give spherical toner particles having small particles and small distribution of particle size. But as the shape of toner is almost spherical, there arise problems such as poor cleaning properties by a blade.

Further there is a difficulty in controlling chargeability, the reason of which is not clearly understood but thought to be attributed to small surface area effective in tribo-charging because of spherical shape and contaminants remaining as impurities such as a surfactant for polymerization and granulation and a catalyst for polymerization.

SUMMARY OF THE INVENTION

The object of the present invention is to provide a toner having a narrow distribution of toner particle size and improved chargeability and cleaning properties.

The present invention relates to a toner for developing electrostatic latent images prepared by the following processes comprising;

a process (a) of forming particles for toner containing at least a resin and a coloring agent in a wet process, a process (b) of aggregating the particles, and a process (c) of the aggregates passing through a minimal gap of 0.5–10 mm under dispersed conditions in air-stream flowing at a high speed to pulverize the aggregates, the gap being formed between a rotator and a rotator or between a rotator and a stator.

DETAILED DESCRIPTION OF THE INVENTION

Figure 1:
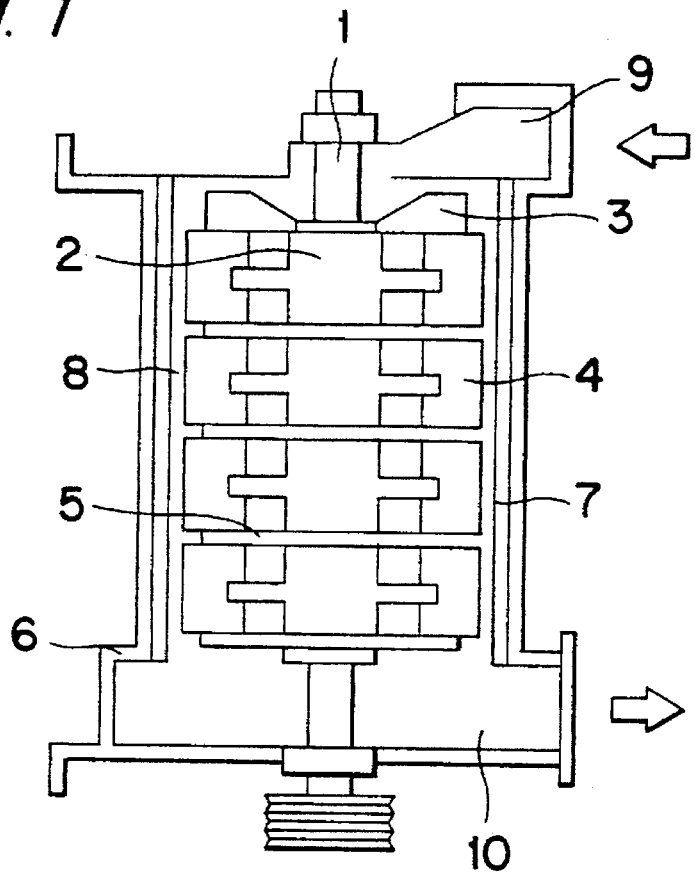
FIG. 1 represents a schematic sectional view of a pulverizing machine.

The present invention relates to a toner for developing electrostatic latent images prepared by the following processes comprising;

a process (a) of forming particles for toner containing at least a resin and a coloring agent in a wet process, a process (b) of aggregating the particles, and a process (c) of the aggregates passing through a minimal gap of 0.5–10 mm under dispersed conditions in air-stream flowing at a high speed to pulverize the aggregates, the gap being formed between a rotator and a rotator or between a rotator and a stator.

In order to prepare a toner of the present invention, first of all, particles containing at least a resin and a coloring agent are granulated in a wet process.

A known granulating method in a wet process may be applied to a granulating method of toner particles, which may include a polymerization method such as a suspension polymerization process and an emulsion polymerization process, or a suspension method including a melting and dispersing process.

In the case of the suspension polymerization process, the granulation is carried out by suspending and polymerizing a polymerizable composition containing a polymerizable monomer which forms a binder resin as a resin component, a polymerization initiator, a coloring agent and an additive in a solvent which does not dissolve the components.

In the case of the emulsion polymerization process, it is preferable to use a seed polymerization method because a general emulsion polymerization can give only fine particles having narrow particle-size distribution. That is, a part of polymerizable monomers and an polymerization initiator are added into an aqueous medium which may contain an emulsifying agent to be stirred and emulsified. Then the rest of the polymerizable monomers are added gradually into the emulsion to form fine particles. With the fine particles as seeds, the polymerization is carried out in a liquid particles of polymerizable monomers containing a coloring agent and other additives.

Other granulating methods in a wet process including a polymerization method are known as a soap-free emulsion polymerization, an encapsulization method (an interfacial polymerization method, in-situ polymerization method), and a non-aqueous dispersion polymerization method In the case of the suspension method, the granulation is carried out by compounding a resin as a binder resin with a coloring agent and other additives under melted conditions and suspending the resultant in a solvent which can not dissolve the components to form particles.

Particles for toner granulated in a wet process have a mean particle size of 1–15 μm, preferably 2–10 μm. In the preparation of a toner of the present invention, it is preferable that organic and/or inorganic fine particles (referred to as "additive particles" hereinafter) are added to the particles for toner after the particles for toner was granulated in the wet process.

Such additive particles are exemplified by a charge controlling agent, a fluidization agent, magnetic particles, an off-set preventive agent and a cleaning assistant, which may be used singly or in combination. When the particles for toner are compounded with the above additives, all kinds of the additives used are not necessarily adhered to the surface of particles for toner. Some kinds of the additives may be compounded together with a binder resin and a coloring agent to be incorporated in the particles for toner. A part of an additive is incorporated in the particles for toner and the rest of the additive may be adhered to the surface of particles for toner.

The magnetic particles, which are added, for example, when a magnetic toner is prepared, are exemplified by magnetite, γ-hematite and various kinds of ferrite.

The off-set preventive agents, which are added in order to improve fixing properties of toner, are concretely exemplified by various kinds of waxes such as polyolefinic waxes, in particular, polypropylene of low molecular weight, polyethylene of low molecular weight, oxidized-type polypropylene and oxidized-type polyethylene, and natural waxes such as carnauba wax.

The fluidizing agents are exemplified by metal oxides such as silica, aluminum oxide and titanium oxide, and magnesium fluoride, which may be used singly in combination.

The cleaning assistants are exemplified by inorganic particles as described above as a fluidizing agent, metallic soap such as stearate and various kinds of synthesized-resin fine particles such as fluororesins, silicone resins, styrene-(metha)acrylic resins, benzoguanamine resins, melamine resins and epoxy resins.

The charge controlling agents are not limited so far as they can give positive or negative charges by frictional charging, including various kinds of inorganic or organic ones.

The additive particles used in the present invention are not limited to the ones as described above but may be further exemplified by organic fine particles such as styrenes, (metha)acrylic resins, olefin resins, fluorine-containing resins, nitrogen-containing (metha)acrylic resins, silicones, benzoguanamines and melamines, which may be granulated by a wet polymerization such as an emulsion polymerization method, a soap-free emulsion polymerization method and a non-aqueous dispersion-polymerization or a vapor phase polymerization method, and inorganic fine particles such as carbides, in particular, silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond-like carbon, nitrides, in particular, boron nitride, titanium nitride and zirconium nitride, borides, in particular, zirconium boride, oxides, in particular, iron oxide, chromium oxide, calcium oxide, magnesium oxide, zinc oxide, copper oxide and colloidal silica, sulfides, in particular, molybdenum sulfide, fluorides, in particular, fluorocarbon, metallic soaps, in particular, aluminum stearate, calcium stearate, zinc stearate and magnesium stearate, non-magnetic inorganic fine particles, in particular, talc and bentonite.

It is preferable that the additive particles used are subjected to a hydrophobic treatment from the view point of stability of humidity resistance of particles for toner.

It is desired that a size of the additive particles used is one fifth or less, preferably 1/10–1/1000 of a mean particle size of the particles for toner obtained by granulation. If the particle size of the additive particles are larger than one fifth of a mean particle size of the particles for toner, the additive particles may not adhere strongly to the surface of the particles for toner in a next aggregating process of the particles for toner.

Further negative chargeable fine resin-particles or positive chargeable fine resi-particles may be preferably used as one of the fine particles as above mentioned in order to control chargeability of toner.

Negative chargeable fine resin-particles are exemplified by fluorine-containing resins such as tetrafluoroethylene resin, trifluoroethylene resin, perfluoroalkoxy (PFA) resin, perfluoroethylenepropylene (FEP) resin, fluoroethylene propylene ether (EPE) resin, ethylene-tetrafluoroethylene (ETFE) resin, vinylidene fluoride (PVDF) resin, vinyl fluoride (PVF) resin, chlorotrifluoroethylene (CTFE) resin, ethylene-chlorotrifluoroethylene (ECTFE) resin, trifluoropropylene resin and hexafluoropropylene resin, fluorovinylidene resin, and fluorine-containing polymers (including its copolymers with styrenes, (metha)acrylic acids and (metha)acrylates) composed of at least fluorine-containing monomers such as fluoroalkyl acrylates and fluoroalkyl methacrylates, in particular, 2,2,2-trifluoroethyl acrylate, 2,2,3,3-tetrafluoropropyl acrylate, 2,2,3,3,4,4,5,5-octafluoroamyl acrylate, 1H,1H,2H,2H-heptadecafluorodecyl acrylate.

Styrene resins and copolymers of styrene/(metha)acrylate may be also used when styrene component is rich or methacrylic acid or acrylic acid is added as one component. Polymers composed of sulfon-group-containing monomers may be also used adequately.

Other resins such as polyester resins, silicone resins and polyethylene resins may be also used. Further fine resin-particles the surface of which is treated with, for example, a coupling agent which can improve negative chargeability or a negative charge-controlling agent such as chromium-complex-type dyes may be also used. The surface treatment with chromium-complex-type dyes can be carried out as follows;

(i) A solvent such as alcohol and water/alcohol which can dissolve a charge controlling agent (CCA) but cannot dissolve fine resin-particles is first selected. CCA is dissolved in the solvent and fine resin-particles are mixed in the resultant solution. Thus the surfaces of the fine particles can be treated with the CCA to improve the chargeability of the fine particles.

(ii) When fine resin-particles in a dispersion are dried, a solution containing CCA dissolved in a solvent is sprayed to coat the surfaces of fine resin-particles. In this method, a Dispacoat (made by Nissin Engineering K.K.), for example, may be used adequately.

(iii) Fine resin-particles are dispersed in air-stream. A solution containing CCA dissolved in a solvent is sprayed into the air-stream through a nozzle to treat surfaces of the fine resin-particles with CCA. In this method, for example, a Coatmizer (made by Frointo K.K.) or a Dispacoat (made by Nissin Engineering K.K.) may be used adequately.

The method (i) above has limitation in the kinds of solvents, but the methods (ii) and (iii) do not have such a limitation. To the contrary, the method (i) is carried out in a wet process, so the dispersion can be utilized for the process of the present invention, but the methods (ii) and (iii) give powder, which therefore must be dispersed again in a solution if used in a wet process.

With respect to the positive chargeable fine resin-particles, fine resin-particles composed of amino-group or nitro-group-containing monomers may be used.

The amino-group-containing monomers are exemplified by amino(metha)acrylic monomers represented by the following formula (I);

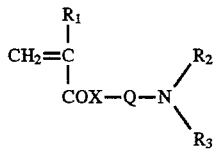

(I)

in which $R_1$ represents a hydrogen atom or a methyl group; $R_2$ and $R_3$ represent respectively a hydrogen atom or an alkyl group of C1–C20; X represents an oxygen atom or a nitrogen atom; Q represents an alkylene group or an arylene group.

These amino(metha)acrylic monomers are particularly exemplified by N,N-dimethylaminomethyl (metha)acrylate, N,N-diethylaminomethyl(metha)acrylate, N,N-dimethylaminoethyl(metha)acrylate, N,N-dimethylaminopropyl(metha)acrylate, p-N,N-dimethylaminophenyl(metha)acrylate, p-N-laurylaminophenyl(metha)acrylate, p-N-stearylaminophenyl(metha)acrylate, p-N,N-dimethylaminobenzyl(metha)acrylate, N,N-dimethylaminoethyl(metha)acrylamide, N,N-dimethylaminopropyl(metha)acrylamide.

Other amino-group-containing monomers, such as N,N-dimethylaminostyrene, N-methylolmethacrylamide and methacrylamide may be used.

Any nitro-group-containing monomer may be used so far as a nitro group is contained therein and the monomer can be radical-polymerized, particularly exemplified by nitrostyrene.

(Metha)acrylate resins and copolymers of styrene/(metha) acrylate may be also adequately used when a (metha) acrylate component is rich.

Other resins such as amino resins, urethane resins epoxy resins, benzoguanamine resins and melamine resins may be also used. Further fine resin-particles the surfaces of which are treated with, for example, a coupling agent which can improve positive chargeability or a positive charge-controlling agent such as nigrosine dyes may be also used. The surface treatment with nigrosine dyes can be carried out in a manner similar to that described in the negative charge-controlling agents.

It is useful that fine resin-particles for charge controlling agent are used in a solution containing a surfactant at as smallest amount as possible in, for example, a soap-free emulsion polymerization method in order to improve charging stability even under high temperature and high humidity conditions. The particles for toner with the charge controlling agent added may be washed sufficiently with water/alcohol. It may be also useful that the charge controlling agent is used after treated with a coupling agent to make the surfaces hydrophobic.

An amount of the additive particles above mentioned is adjusted depending on kinds and functions of the additive particles used. When the additive particles used can not be dissolved, the amount thereof is 0.01–10 parts by weight, preferably 0.1–5 parts by weight on the basis of 100 parts by weight of particles for toner. If the amount of the additive particles is less than 0.01 part by weight, the amount of the additive particles adhering to the surfaces of the additive particles is insufficient so that the functions of the additives can not be obtained satisfactorily. If the amount of the additive particles is more than 10 parts by weight, the additive particles may separate out from the surfaces of toner particles when used as a toner, because some additive particles adhere weakly to the surfaces of particles for toner even after particles for toner are subjected to an aggregating process. In particular, when the additive particles are charge controlling agents, an additive amount thereof is desirably 0.1–5 parts by weight, preferably 0.1–3 parts by weight on the basis of 100 parts by weight of particles for toner. When the additive particles are fluidizing agents, an additive amount thereof is desirably 0.1–5 parts by weight, preferably 0.5–3 parts by weight on the basis of 100 parts by weight of particles for toner.

When the additive particles used can be dissolved, the amount thereof is 0.01–30 parts by weight, preferably 1.0–30 parts by weight, more preferably 1.0–15 parts by weight on the basis of 100 parts by weight of particles for toner. If the amount of the additive particles is less than 0.01 part by weight, the amount of the additive particles adhering to the surfaces of the additive particles is insufficient so that the functions of the additives can not be obtained satisfactorily. If the amount of the additive particles is more than 30 parts by weight, the some additive particles may separate out from the surfaces of toner particles to adhere to a developing sleeve, resulting in dropping of toner, because some additive particles adhere weakly to the surfaces of particles for toner.

The additive particles are added, for example, as follows;

(i) The additive particles are mixed with particles for toner in a wet process, followed by being subjected to an aggregating method.

(ii) Particles for toner are aggregated and then the additive particles are added in a wet process.

(iii) Particles for toner are aggregated and dried to give aggregates and then the additive particles are admixed with the aggregates to be pulverized.

In another method, the granulates prepared in a wet process are dried and then the additive particles are admixed with the dried granulates (powder-powder mixing).

Several aggregating methods are exemplified. When the additive particles are added in a wet process, the following methods, for example, are given.

(i) Prior to a drying process, a dispersion containing particles for toner and the additive particles is subjected to a heat-treatment at a temperature between glass transition point (Tg) or more of a resin contained in the particles for toner and boiling point of liquid medium of the dispersion.

(ii) Prior to a drying process, a solution containing a nonaqueous solvent which can dissolve or swell the resin is brought into contact with particles for toner with the additive particles adhered to the surfaces thereof.

(iii) A temperature and/or a pressure in a drying process are set a little severer than those of general drying conditions.

(iv) In a drying process, a solution containing a nonaqueous solvent which can dissolve or swell the resin contained in the particles for toner is brought into contact with particles for toner.

The aggregating methods (i)–(iv) above mentioned may be used in combination. In the methods (i)–(iii) above, when the resultant is preserved under high humid conditions after dried, more satisfactory aggregates are given. Further the following methods may be taken.

(v) In a drying process, particles for toner with the additive particles adhered to surfaces of the particles are subjected to a heat-treatment at a temperature between glass transition point (Tg) or more of a resin contained in the particles for toner and softening point (Tm) of the resin +60° C.

(vi) In a drying process, a solution containing a nonaqueous solvent which can dissolve or swell a resin contained in the particles for toner is brought into contact with the particles with the additive particles adhered to the surfaces thereof, followed by drying again.

The two methods (v) and (vi) may be used in combination.

Through the process above mentioned, the surfaces of particles for toner melt, dissolve and/or swell so that the particles adhere each other to form aggregates. Adhering strength between particles depends on particle size of the particles. The smaller the particle size, the stronger is the adhering strength is. When the particles for toner granulated in the wet process having particle size between 2–8 μm adhere each other to form aggregates, the adhering strength between the particles are relatively weak so that the aggregates are almost pulverized at the adhering portions in the aggregates by small external force. To the contrary, when fine particles having a particle size of 1 μm or less adhere to larger particles having particle size between 2–8 μm, the adhering strength is strong enough for the fine particles not to be separated out by small external force.

In the preparation of a toner of the present invention, a drying treatment of the particles for toner is carried out after or before the aggregation treatment, or at the same time of the aggregation treatment. Conventional drying apparatus such as a hot-air drying apparatus and a spray drier may be used. It is preferable to carry out the drying process at the same time of the aggregation treatment. When aggregates are formed in a drying process, a medium-fluidizing drier (for example, MSD made by Nara Kikai Seisakusyo K.K.), a wet surface-modifying apparatus (for example, Dispacoat made by Nissin Engineering K.K.) are suitably used.

The dried aggregates of the particles for toner are further subjected to a pulverizing process after the aggregating process and the drying process.

The pulverizing process is carried out by the aggregates passing through a gap of 0.5–10 mm under dispersed conditions in air-stream flowing at high speed, the gap being formed between a rotator and a rotator or between a rotator and a stator. The pulverization is effected by collision between the aggregates, the aggregates and the rotor, and the aggregates and the stator.

In general, a surfactant is necessarily used in a wet granulating method. The surfactant is originally required to have a function group having high affinity for water. This surfactant affects chargeability of toner, in particular, environmental stability. Moreover various contaminants which affect chargeability adversely are included other than the surfactant in a granulating method. The contaminants adhere to surfaces of the particles in the wet granulating process.

In the present invention, after granulation, the resultant particles are once aggregated and then subjected to the pulverizing process as above mentioned. In the pulverizing process, components existing on surfaces of particles, such as surfactants and the like, are removed. Such a function is referred to as a "peeling function". Such a peeling function effects to form new or fresh surfaces different from the particle surfaces formed in the wet granulating process. Therefore, after the pulverization process, few particles of surfactants exist on the surfaces of toner particles and charging stability can be achieved. To the contrary when a pulverizing process is carried out by use of a jet-grinder, the particles can not be given the peeling function, so that the particle surfaces formed in the wet granulating process remain, i.e. components such as surfactants and the like exist on surfaces of toner particles. These components may affect chargeability adversely. Further in the jet grinder, the pulverization is effected by collision between particles and a wall of the grinder or a collision plate, so that not only the particles are separated out from adhering portions but also the particles themselves are broken to give fine particles smaller than desired toner particles. A suitable minimal gap in the pulverizing treatment depends on, for example, outer diameter of a rotor. Therefore the gap is adjusted in consideration of apparatus assembling. If the minimal gap is smaller than 0.5 mm, particles can not pass through the gap under stabilized conditions. The gap may be choked up with aggregates near the entrance to the gap. The aggregates may also adhere firmly to the rotator and/or the stator. If the gap is larger than 10 mm, whirling stream which is needed for pulverization (and surface-modification) can not be generated sufficiently, so that impact force is weak between particles and not uniform. Satisfactory pulverization and surface-modification can not be achieved.

The pulverizing process is carried out in air-stream at room temperature, in particular, 0°–40° C. A high temperature of the introducing air is not preferred in general, because pulverizing performance is lowered. When the aggregates pass through plural gaps, the introducing air to the second gap or the successive gaps may be heated in order to alter surface properties of particles (for example, to make particle-shape spherical). Treatment components may be heated.

A retention time in the pulverizing process is adjusted within scores of seconds, preferably a few seconds from the viewpoint of productivity. A speed of air-stream is set from the above consideration.

Concrete machines for pulverization are exemplified by Criptron System Cosmos (made by Kawasaki Jukogyo K.K.) (in particular, L-typs is most preferable because a rotor and a stator are made lengthen to heighten efficiency), Fine Mill (made by Nippon Newmatchick Kogyo K.K.), Turbomill (made by Turbo Kogyo K.K.) and Cosmomizer (made by Nara Kikai Seisakusyo K.K.). An example of the pulverizing machines is explained by referring to FIG. 1. The apparatus shown in FIG. 1 is used in Example 4. A rotation component is constituted of a distributor (3), plural rotors (2) having a number of blades at circumferential portion and dashboards (5) in contact therewith. A liner (7) having a number of grooves in the inner surface is attached to a casing (6). When the rotor (2) rotates at a high speed, whirling stream and pressure vibration generate inside the apparatus. Aggregates are drawn in through a feeder together with air. The drawn aggregates flow around a revolving shaft (1) in a whirling room (9). Flow of the aggregates is accelerated by the distributor (3) and the aggregates are distributed uniformly to a pulverizing room (8). The distributed aggregates are pulverized instantly in vigorously whirling air-stream. The pulverized aggregates are exhausted from an outlet of a whirling room (10) together with air without short pass in the apparatus.

The apparatus above mentioned can not only pulverize aggregates but also fix more strongly additive particles and other fine particles adhering to surfaces of particles for toner by aid of mechanical impact. Thus obtained particles are referred to as "toner particles" hereinafter.

Additive particles are fixed strongly on surfaces of toner particles. Very fine particles are almost not included in the toner particles. The shape of toner particles are non-spherical, being different from the spherical shape formed in the wet granulation process, because the particles for toner undergo the aggregating process and the pulverizing process. It is to be noticed that the final shape of toner particles can be controlled to a certain degree from almost spherical shape to not spherical or irregular shape by changing adhering strength in the aggregating process.

Thus pulverized toner particles are air-classified in a classifying process if necessary.

The final toner particles have a mean particle size of 1–15 μm, preferably 2–10 μm, and preferably 50 percents by weight or more, more preferably 60 percents by weight or more of the toner particles have a size within the range between mean particle size ±25 percents.

A toner for developing electrostatic latent images in the present invention contains at least a resin as a binder and a coloring agent. So far as additive particles are made to adhere to surfaces thereof through the aggregating process and the pulverizing process, a toner of the present invention can take various constitutions such as magnetic type and non-magnetic type, negative charging type and positive charging type in accordance with a developing method.

With respect to a resin constituting a toner, it is not limitative and any binder resin for a toner can be used, being exemplified by thermoplastic resins styrenes, (metha)acrylic resins, olefin resins, polyester resins, amide resins, carbonate resins, polyethers and polysulfones; thermosetting resins such as epoxy resins, urea resins and urethane resins; copolymers thereof, or blend thereof. Further, an oligomer or a prepolymer of the thermosetting resins may be included. A mixture of the oligomer or the prepolymer with the resins above mentioned or a crosslinking agent may be used.

Recently, a developing means which works at high speed is desired. A toner used in such a developing means at high speed is required to fix onto copying paper speedily and to separate from a fixing roller easily. From this point, a resin constituting a toner such as homo and copolymers of styrenes, (metha)acrylic monomers and (metha)acrylates, and polyesters are preferable. These polymers have preferably a relationship among number average molecular weight (Mn), weight average molecular weight (Mw) and z average molecular weight (Mz) as below; $1000 \leqq Mn \leqq 7000$, $40 \leqq Mw/Mn \leqq 70$, $200 \leqq Mz/Mn \leqq 500$, more preferably, Mn is $2000 \leqq Mn \leqq 7000$. When a toner is applied to an oilless-type, it is preferable to have a glass transition point of 55°–80° C., a softening point of 80°–150° C. and more preferably to contain 5–20 percents by weight of gel components. In order to improve resistance to vinyl chloride, it is desirable to use polyesters, in particular, the ones containing 5–20 percents by weight of gel components.

When a light-transmittable color toner for OHP or full color is desired, it is preferable to use polyesters as a binder resin from the view points of resistance to vinyl chloride, light-transmittance required for the light-transmittable color toner and adhesivity with a OHP sheet. More preferably, the polyesters are linear ones having a glass transition point of 55°–70° C., a softening point of 80°–150° C. and a number average molecular weight (Mn) of 1000–15000 and a molecular distribution of 4 or less.

As a binder resin for a light-transmittable color toner, urethane-modified linear polyesters (C) may be also used adequately, which are given by treating linear polyesters (A) with diisocyanates (B). The urethane-modified linear polyesters in the present invention contain mainly urethane-modified linear polyesters prepared by treating one mole of a linear polyester resin, which is formed by dicarboxylic acids and diols and has a number average molecular weight of 2000–15000, an acid value of 5 or less and substantially hydroxy groups at the chain end, with 0.3–0.95 moles of diisocyanates (B) and the resin (c) having a glass transition point of 40°–80° C. and an acid value of 5 or less.

Linear polyesters may be copolymerized with styrene monomers, acrylic monomers and aminoacrylic monomers by a graft or block polymerization method to give modified polymers having the same glass transition point, a softening point and a molecular weight as those above mentioned. Such modified polyesters may be used in the present invention.

A coloring agent contained in a toner of the present invention is not limited. Various kinds and colors of well known organic or inorganic pigments or dyes may be used. The coloring agent is contained generally at a content of 1–20 parts by weight, preferably 2–10 parts by weight on the basis of 100 parts by weight of the binder resin. If the content is more than 20 parts by weight, fixing properties of toner are deteriorated. If the content is less than 1 part by weight, a desired density of copy images may not achieved.

The present invention is further explained in more detail demonstrating concrete examples.

Example 1 (Preparation Example A of Toner)

| Ingredient | parts by weight |
|---|---|
| styrene | 60 |
| n-butylmethacrylate | 35 |
| methacrylic acid | 5 |
| 2,2-azobis-(2,4,-dimethylvaleronitrile | 0.5 |
| polypropylene of low molecular weight (Viscol 665P; made by Sanyo Kasei Kogyo) | 3 |
| carbon black (MA#8; made by Mitsubishi Kasei Kogyo K.K.) | 8 |

The above ingredients were mixed in a Sand Grinder to give a polymerizable composition. The composition was added to a 3% aqueous solution of arabic gum. The obtained solution was stirred at the revolving speed of 4000 rpm in a stirrer TK AUTO HOMO MIXER (made by Tokusyu Kika Kogyo K.K.) to be polymerized at 60° C. for 6 hours. Thus spherical particles having a mean particle size of 6 μm (particles for toner) were obtained.

Separately, tetrafluoroethylene Dispersion (made by Mitsui Dupon Fluoro Chemical K.K.) and hydrophobic titanium oxide (T-805; made by Nippon Aerosil K.K.) were dispersed in an aqueous medium at a solid-weight ratio of 5:1 by means of Sand Mill (Paint Conditioner; made by Red Devil K.K.). The obtained mixture of tetrafluoroethylene/titanium oxide was added to the above dispersion of the spherical particles at a ratio of 1.5 parts by weight of solids of the mixture to 100 parts by weight of solids of the dispersion of the spherical particles. Then stirring was continued to treat surfaces of the particles for toner with the mixture of tetrafluoroethylene/titanium oxide. Then filtration and washing were repeated. The resultant dispersion was taken into a drying machine (medium-flowing-drying machine MSD; made by Nara Kikai Seisakusyo K.K.) to be subjected to an aggregating process. The particles for toner were melted and aggregated with additive fine particles existing at interfaces of particles for toner to give block-like aggregates.

The aggregates were pulverized for surface modification by use of Criptron system (KTM-XL type; made by Kawasaki Ju-kogyo K.K.) under such conditions as air-temperature of inlet of 10° C., air-temperature of outlet of 28° C., temperature of 10° C. at treating part cooled with water, minimal gap between stator and rotator of 1 mm and revolution speed of 18000 rpm. Thus toner particles having a mean particle size of 6.2 μm were obtained. Hydrophobic silica (H-2000; made by Wacker K.K.) of 0.2 parts by weight was added to the toner particles of 100 parts by weight. The mixture was treated in Henschel mixer (made by Mitsui Miike Kakooki K.K.) at 1500 rpm for 1 minute to give Toner A.

Comparative Example 1 (Preparation Example B of Toner)

The same ingredients as those used in Example 1 and a chromium-complex-type dye (S-34; made by Orient Kagaku K.K.) as a negative-charge controlling agent of 3 parts by weight were mixed in a Sand Grinder to give a polymerizable composition. The composition was added to a 3% aqueous solution of arabic gum. The obtained solution was stirred at the revolving speed of 4000 rpm in a stirrer TK AUTO HOMO MIXER (made by Tokusyu Kika Kogyo K.K.) to be polymerized at 60° C. for 6 hours. After polymerization, the solution was cooled, washed with water three times and filtered to give spherical particles having a mean particle size of 6.2 μm (particles for toner). Hydrophobic silica (H-2000; made by Wacker K.K.) of 0.2 parts by weight was added to the spherical particles of 100 parts by weight. The mixture was treated in Henschel mixer at 1500 rpm for 1 minute to give spherical Toner B.

Example 2 (Preparation Example C of Toner)

(Production Method of Fine Particles (a))

Ammonium persulfate of 0.4 g dissolved in ion-exchanged water of 800 g was placed in a four-necked flask. While the inside of the flask was replaced with nitrogen, the solution was heated to 75° C. Styrene of 160 g and butyl acrylate of 40 g were added to the flask to be polymerized for 6 hours while being stirred at 400 rpm. Uniform particles having a mean particle size of 0.1 μm and a glass transition temperature of 70° C. were obtained. The dispersion was dried by means of Dispacoat (made by Nissin Engineering K.K.) to give Fine Particles (a).

(Production Method of Toner Particles)

Polyester resin (NE-382; made by Kao K.K.) of 100 g dissolved in a mixed solvent of methylene chloride/toluene (8/2) of 400 g and phthalocyanine pigment of 5 g were placed in a ball mill to be mixed and dispersed uniformly. The dispersion was added to an aqueous solution containing in ion-exchange water (1000 g) 60 g of 4% solution of methyl cellulose (Metocell K35LV; made by Daw Chemical K.K.) as a dispersion-stabilizing agent, 5 g of 1% solution of dioctyl sulfosuccinate, sodium salt (Nikkol OTP75; made by Nikko Chemical K.K.) and 0.5 g of sodium hexametaphosphate (made by Wako Junyaku K.K.) to form dispersed particles of 3–10 μm in mean particle size by use of T.K. AUTO HOMO MIXER (made by Tokusyu Kika Kogyo K.K.).

Separately, hydrophobic titanium oxide (T-805; made by Nippon Aerosil K.K.) was dispersed in water by use of Sand Mill (Paint Conditioner; made by Red Devil K.K.) in advance.

The obtained dispersion of titanium oxide was added to the above dispersion of the dispersed particles at a ratio of 1.5 parts by weight of solids of the titanium oxide to 100 parts by weight of solids of the dispersed particles. Then stirring was continued to treat surfaces of the particles for toner with titanium oxide. Then filtration and washing were repeated to obtain cake-like particles. The cake-like particles were treated in a hot-air drying machine at 80° C. under 85 HR % atmosphere for 5 hours. Thus the particles for toner were melted and aggregated with additive fine particles existing at interfaces of the particles for toner to give block-like aggregates. These aggregates were further dried by air at 40° C. under 50 HR % atmosphere for 5 hours. The block-like aggregates of 100 parts by weight, Fine Particles (a) of 8 parts by weight and negative charge-controlling agent LR-151 (made by Nippon Karritto K.K.) of 1.5 parts by weight were mixed at 3000 rpm for 2 minutes in Henschel mixer (made by Mitsui Miike Kakooki K.K.).

The mixture was pulverized for surface modification by use of Criptron system (KTM-XL type; made by Kawasaki Ju-kogyo K.K.) under such conditions as air-temperature of inlet of 10° C., air-temperature of outlet of 31° C., temperature of 10° C. at treating part cooled with water, minimal gap between stator and rotator of 1 mm and revolution speed of 18000 rpm. Thus toner particles having a mean particle size of 6.3 μm were obtained. Hydrophobic silica (H-2000; made by Wacker K.K.) of 0.3 parts by weight and hydrophobic titanium oxide (T-805; made by Nippon Aerosil K.K.) of 0.5 parts by weight were added to the toner particles of 100 parts by weight. The mixture was treated in Henschel mixer (made by Mitsui Miike Kakooki K.K.) at 1500 rpm for 1 minute to give Toner C.

Example 3 (Preparation Example D of Toner)

(Production Method of Fine Particles (b))

Dihydric acid salt of 2,2'-azobis(2-aminodipropane) of 0.2 g dissolved in ion-exchanged water of 800 g was placed in a four-necked flask. After the inside of the flask was replaced with nitrogen, the solution was heated to 70° C. Methyl methacrylate of 150 g was added to the flask to be polymerized for 1 hour while the solution was stirred at 150 rpm. Then methyl methacrylate of 50 g and dimethylaminoethyl methacrylate of 4 g was dropped through a dropping funnel for 1 hour. After dropped, they were polymerized for 4 hours to give Fine Particles (b) having a mean particle size of 0.1 μm and a glass transition point of 78° C.

Separately, instead of tetrafluoroethylene Dispersion (made by Mitsui Dupon Fluoro Chemical K.K.) and hydrophobic titanium oxide (T-805; made by Nippon Aerosil K.K.) which were used in Example 1, Fine Particle (b) and hydrophobic alumina (Aluminum Oxide C; made by Nippon Aerosil K.K.) the surface of which had been treated with methyl silicone were dispersed in an aqueous medium at a solid-weight ratio of 5 (the former):1 (the latter) by means of Sand Mill (Paint Conditioner; made by Red Devil K.K.). The obtained mixture of Fine Particle (b)/hydrophobic alumina was added to the dispersion of the particles for toner obtained in Example 1 at a ratio of 1.5 parts by weight of solids of the mixture to 100 parts by weight of solids of the dispersion of the particles for toner. Then stirring was continued to treat surfaces of the particles for toner with the mixture of Fine Particle (b)/hydrophobic alumina. Then filtration and washing were repeated. The resultant was taken into a drying machine to be subjected to an aggregating process at 80° C. under 85 HR % atmosphere for 5 hours. Thus the particles for toner were melted and aggregated with additive fine particles existing at interfaces of the particles for toner to give block-like aggregates. These block-like aggregates were further dried by air at 40° C. under 50 HR % atmosphere for 3 hours.

The aggregates were pulverized for surface modification by use of Fine Mill (FM-300S; made by Nippon Pneumatic K.K.) under such conditions as air-temperature of inlet of 12° C., air-temperature of outlet of 32° C., minimal gap between stator and rotator of 3 mm and revolution speed of 7500 rpm. Thus toner particles having a mean particle size of 6 μm were obtained. Then Hydrophobic silica (R-972; made by Nippon Aerosil K.K.) of 0.2 parts by weight was added to the toner particles of 100 parts by weight. The mixture was treated in Henschel mixer (made by Mitsui Miike Kakooki K.K.) at 1500 rpm for 1 minute to give Toner D.

Example 4 (Preparation Example E of Toner)

Instead of tetrafluoroethylene resin and titanium oxide which were used in Example 1, hydrophobic silica (H-2000/4; made by Wacker K.K.) and silane coupling agent (TSL8311; made by Toshiba Silicone K.K.) of 1 percent by weight on the basis of the hydrophobic silica were dispersed in sufficient methanol. The obtained dispersion of hydrophobic silica was added to the dispersion of the particles for toner obtained in Example 1 at a ratio of 0.5 parts by weight of solids to 100 parts by weight of solids of the dispersion of the particles for toner. Then stirring was continued to treat surfaces of the particles for toner with the hydrophobic silica. Then filtration and washing were repeated. The resultant was taken into a drying machine to be subjected to an aggregating process at 80° C. under 85 HR % atmosphere for 5 hours. Thus the particles for toner were melted and aggregated with additive fine particles existing at interfaces of the particles for toner. The resultant was further air-dried at 40° C. under 50 HR % atmosphere for 3 hours to give block-like aggregates.

The obtained block-like aggregates of 100 parts by weight, hydrophobic silica (H-2000; made by Wacker K.K.) of 1.5 parts by weight and Carix allene (E-90; made by Orient Kagaku K.K.) of 1.5 parts by weight were mixed at 3000 rpm for 1 minute in Henschel Mixer (made by Mitsui Miike Kakooki K.K.). The resultant was pulverized for surface modification by use of Turbo Mill (equipped with cold air-providing apparatus; T-400-RS type; made by Turbo Kogyo K.K.) under such conditions as air-temperature of inlet of 12° C., air-temperature of outlet of 32° C., minimal gap between stator and rotator of 2 mm and revolution speed of 6200 rpm. Thus toner particles having a mean particle size of 6.1 μm were obtained. Then Hydrophobic silica of 0.2 parts by weight was added to the toner particles of 100 parts by weight. The mixture was treated in Henschel mixer (made by Mitsui Miike Kakooki K.K.) at 1500 rpm for 1 minute to give Toner E.

Example 5 (Preparation Example F of Toner)

(Preparation Method of Core Particles (a))

Styrene of 160 g, butyl methacrylate of 90 g, isobutyl acrylate of 3 g, polypropylene of low molecular weight (Viscol 605P; made by Sanyo Kasei Kogyo K.K.) of 5 g, lauryl mercaptan of 2 g, silane-coupling agent (TSL8311; made by Toshiba Silicone K.K.) of 2 g, carbon black (#2300; made by Mitsubishi Kasei Kogyo K.K.) of 10 g, magnetic magnetite (EPT-1000; made by Toda Kogyo K.K.) and azobisisobutyronitrile of 6 g were mixed in Sand Grinder to prepare a uniform dispersion of a polymeriable composition.

The obtained dispersion was added to an aqueous solution containing in ion-exchange water (650 g) 60 g of 4 wt % solution of methyl cellulose (Metocell K35LV; made by Daw Chemical K.K.) as a dispersion-stabilizing agent, 5 g of 1 wt % solution of dioctyl sulfosuccinate, sodium salt (Nikkol OTP75; made by Nikko Chemical K.K.) and 0.3 g of sodium hexametaphosphate (made by Wako Junyaku K.K.) to form dispersed particles of 3–10 μm in mean particle size by use of Homojetter. The suspension was placed in a four-necked flask. The inside of the flask was replaced with nitrogen. The suspension inside the flask was polymerized at 60° C. at stirring speed of 100 rpm for 24 hours to give Core Particles (a) having a glass transition point (Tg) of 54° C., a softening point (Tm) of 82° C., an average number molecular weight (Mn) of 8000 and a ratio of average weight molecular weight (Mw) to average number molecular weight (Mn) of 24.

(Preparation Method of Fine Particles (c))

Fine Particles (c) having a mean particle size of 0.2 μm and a glass transition point of 80° C. were prepared in a manner similar to that in Production Method of Fine Particles (a) of Example 2, except that styrene of 140 g, methyl methacrylate of 60 g and methacrylic acid of 8 g were used.

(Production Method of Toner Particles)

A 20 wt % slurry of Fine Particles (c) was added to 28 wt % slurry (800 g) of the Core Particles (a). The resultant mixture was dispersed in ion-exchanged water of 1000 g. Ammonium persulfate of 5 g was added to the solution. The resultant dispersion was placed in a four flask to be treated under nitrogen atmosphere at 70° C. at a stirring rate of 160 rpm for 5 hours. Then filtration and washing were repeated to obtain cake-like particles. The cake-like particles were taken into a drying machine (MSD-200 type) to dry the same by hot-air under conditions of 80° C. and 85 RH %. The particles for toner were melted and aggregated with additive fine particles existing at interfaces of particles for toner to give block-like aggregates.

The aggregates were further air-dried at 40° C. under 50 RH % atmosphere for 5 hours. The dried aggregates were pulverized for surface modification at 18000 rpm by use of Criptron system (KTM-XL type; made by Kawasaki Ju-kogyo K.K.). Thus toner particles having a mean particle size of 6 μm were obtained. Hydrophobic silica (H-2000; made by Wacker K.K.) of 0.2 parts by weight was added to the toner particles of 100 parts by weight. The mixture was treated in Henschel mixer (made by Mitsui Miike Kakooki K.K.) at 1500 rpm for 1 minute to give Toner F.

Example 6 (Preparation Example G of Toner)

A dispersion containing suspended particles to the surfaces of which fine resin-particles adhered was prepared in a manner similar to that in Example 2, except that hydrophobic titanium oxide was not used. The resultant dispersion was taken into a drying machine (medium-flowing-drying machine MSD; made by Nara Kikai Seisakusyo K.K.) to be subjected to an aggregating process. The particles for toner were melted and aggregated with additive fine particles existing at interfaces of particles for toner to give block-like aggregates.

The aggregates were pulverized for surface modification by use of Criptron system (KTM-XL type; made by Kawasaki Ju-kogyo K.K.) at a revolution rate of 18000 rpm. Thus toner particles having a mean particle size of 6 μm were obtained. Hydrophobic silica (H-2000; made by Wacker K.K.) of 0.3 parts by weight and hydrophobic titanium oxide (T-805; made by Nippon Aerosil K.K) of 0.5 parts by weight were added to the toner particles of 100 parts by weight. The mixture was treated in Henschel mixer (made by Mitsui Miike Kakooki K.K.) at 1500 rpm for 1 minute to give Toner G.

Example 7 (Preparation Example H of Toner)

(Production Method of Fine Particles (d))

Uniform particles having a mean particle size of 0.1 μm and a glass transition point of 70° C. were prepared in a manner similar to that in Production Method of Fine Particles (a) of Example 2, except that styrene/butyl acrylate/2,2,2-trifluoroethyl acrylate were used at a composition ratio of 70/20/10. The obtained dispersion was dried by means of Dispacoat (made by Nissin Engineering K.K.) to give Fine Particles (d).

(Production Method of Toner Particles)

In this method, tetrafluoroethylene resin Dispersion (made by Mitsui Dupon Fluoro Chemical K.K.) was not used in Example 1, hydrophobic titanium oxide (T-805; made by Nippon Aerosil K.K.) was dispersed in aqueous medium by use of Sand Mill (Paint Conditioner; made by Red Devil K.K.). The obtained dispersion of titanium oxide was added to the dispersion of the particles for toner obtained in Example 1 at a ratio of 1 part by weight of solids to 100 parts by weight of solids of the dispersion of the particles for toner. Then stirring was continued to treat surfaces of the particles for toner with titanium oxide.

Then filtration and washing were repeated. The resultant dispersion was taken into a drying machine (medium-flowing-drying machine MSD; made by Nara Kikai Seisakusyo K.K.) to be subjected to an aggregating process. The particles for toner were melted and aggregated with additive fine particles existing at interfaces of particles for toner to give block-like aggregates.

The block-like aggregates of 100 parts by weight and Fine Particles (d) of 8 parts by weight were mixed at 3000 rpm for 2 minutes in Henschel mixer (made by Mitsui Miike Kakooki K.K.).

The mixture was pulverized for surface modification at 18000 rpm by use of Criptron system (KTM-XL type; made by Kawasaki Ju-kogyo K.K.). Thus toner particles having a mean particle size of 6 μm were obtained. Hydrophobic silica (H-2000; made by Wacker K.K.) of 0.2 parts by weight was added to the toner particles of 100 parts by weight. The mixture was treated in Henschel mixer (made by Mitsui Miike Kakooki K.K.) at 1500 rpm for 1 minute to give Toner H.

Example 8 (Preparation Example I of Toner)

Instead of tetrafluoroethylene Dispersion (made by Mitsui Dupon Fluoro Chemical K.K.) and hydrophobic titanium oxide (T-805; made by Nippon Aerosil K.K.) which were used in Example 1, Fine Particle (b) prepared in Example 3 and hydrophobic alumina (Aluminum Oxide C; made by Nippon Aerosil K.K.) the surface of which had been treated with methyl silicone were dispersed in an aqueous medium at a solid-weight ratio of 5 (the former):1 (the latter) by means of Sand Mill (Paint Conditioner; made by Red Devil K.K.). The obtained mixture of Fine Particle (b)/hydrophobic alumina was added to the dispersion of the particles for toner obtained in Example 1 at a ratio of 1.5 parts by weight of solids of the mixture to 100 parts by weight of solids of the dispersion of the particles for toner. Then stirring was continued to treat surfaces of the particles for toner with the mixture of Fine Particle (b)/hydrophobic alumina. Then filtration and washing were repeated. The resultant was taken into a drying machine to be subjected to an aggregating process at 80° C. under 85 HR % atmosphere for 5 hours. Thus the particles for toner were melted and aggregated with additive fine particles, in particular, very fine particles of 1 μm or less, existing at interfaces of the particles for toner to give block-like aggregates.

The aggregates were further air-dried at 40° C. under 50 RH % atmosphere for 5 hours. The dried aggregates were pulverized for surface modification at 18000 rpm by use of Criptron system (KTM-XL type; made by Kawasaki Ju-kogyo K.K.). Thus toner particles having a mean particle size of 6 μm were obtained. Hydrophobic silica (R-972; made by Nippon Aerosil K.K.) of 0.2 parts by weight was added to the toner particles of 100 parts by weight. The mixture was treated in Henschel mixer (made by Mitsui Miike Kakooki K.K.) at 1500 rpm for 1 minute to give Toner I.

Carrier

Three types of Carriers A–C prepared as below were used to be mixed with toners for developing electrostatic latent images as prepared above.

Carrier A

Polyester resin (NE-1110; made by Kao K.K.) of 100 parts by weight, inorganic magnetic particles (MFP-2; made by TDK K.K.) of 600 parts by weight and carbon black (MA#8; made by Mitsubishi Kasei K.K.) were mixed and pulverized sufficiently in Henschel Mixer. The mixture was fused and kneaded by use of an extrusion kneader wherein the temperature of cylinder and cylinder head was set to 180° C. and 170° C. respectively. The kneaded mixture was cooled and pulverized coarsely, followed by being pulverized finely in a jet mill. The resultant was classified by use of a classifier to give a binder-type carrier having a mean particle size of 55 μm.

Carrier B

The surface of ferrite carrier core (F-300; made by Powdertech K.K.) was coated with thermosetting silicone resin by use of a rolling and fluidizing bed (SPIRA COTA; made by Okada Seiko K.K.) to give Carrier B having a mean particle size of 50 μm.

Carrier C (1) Preparation of Titanium-containing Catalyst

N-heptane, which had been dehydrated at room temperature, of 200 ml and magnesium stearate, which had been dehydrated at 120° C. under vacuum (2 mmHg), of 15 g (25 mmol) were put into a flask having a capacity of 500 ml replaced with argon to be turned into a slurry. Titanium tetrachloride of 0.44 g (2.3 mmol) was added to drop by drop to the resulting slurry with stirring and then the resulting mixture was heated and subjected to a reaction for one hour with refluxing. A viscous and transparent solution of a titanium-containing catalyst was obtained.

(2) Evaluation of Activity of Titanium-containing Catalyst Ingredient

Dehydrated hexane of 400 ml, triethyl aluminum of 1.8 mmol, diethyl aluminum chloride of 0.8 mmol and the titanium-containing catalyst ingredient, which was obtained in the above described (1), of 0.004 mmol as titanium atoms were put in an autoclave having a capacity of 1 liter replaced with argon and heated to 90° C. In this time, a pressure inside the system amounted to 1.5 kg/cm$^2$ G. Then hydrogen was supplied to increase the pressure to 5.5 kg/cm$^2$ G and ethylene was continuously supplied so that the total pressure might be kept at 9.5 kg/cm$^2$ G. The polymerization was carried out for one hour to obtain a polymer of 70 g. The polymerization activity was 365 kg/g·Ti/Hr and the MFR (the molten fluidity at 190° C. under load of 2.16 kg; JIS K7210) of the obtained polymer was 40.

(3) Reaction of Titanium-containing Catalyst Ingredient with Fillers and Polymerization of Ethylene Hexane, which had been dehydrated at room temperature, of 500 ml and sinterred ferrite powders F-300 (having a mean particles diameter of 50 μm made by Powdertech K.K.), which had been dried for 3 hours at 200° C. under vacuum (2 mmHg), of 450 g were put in an autoclave having the capacity of 1 liter replaced with argon. The titanium-containing polymerization catalyst ingredient (0.01 mmol as titanium atoms) obtained according to (1) above mentioned was added and the resulting mixture was subjected to a reaction about 1 hour. Ketchen Black EC (made by Lion Akuzo K.K.) of 0.16 g was added through an upper nozzle of the autoclave. (Ketchen Black EC, which had been dried under vacuum at 200° C., was turned into a slurry with dehydrated hexane. This slurry was used in this case.).

Subsequently, triethyl aluminum of 1.0 mmol and diethyl aluminum chloride of 1.0 mmol were added and the resulting mixture was heated to 90° C. In this time, a pressure inside a system amounted to 1.5 kg/cm$^2$ G. Then, hydrogen was supplied to increase the pressure up to 2 kg/cm$^2$ G followed by conducting the polymerization for 58 minutes with continuously supplying ethylene so that the total pressure might be kept at 6 kg/cm$^2$ G. Thus 472 g of polyethylene composition containing ferrite and Ketchen Black was obtained. The dried powders exhibited a uniform grayish color and it was found by electron microscopic observation that a surface of ferrite was thinly coated with polyethylene. The composition was analyzed by TGA (thermogravimetric analysis) to find that a weight ratio of ferrite:polyethylene:Ketchen Black EC was 29:1:0.01. The ferrite particles coated with polyethylene were filtered through openings of 75 μm to remove aggregates and further filtered through openings of 38 μm to remove free polyethylene particles. Thus Carrier C was obtained.

(4) Physical Properties of Carrier C

Mean particle size: 51 μm. Ferrite-filling ratio: 96.6 wt %. Specific gravity: 4.53. Molecular weight (Mw) of resin-layer: $8.1\times10^{10}$. Electric resistance: $4.5\times10^{9}$ Ω·cm.

Evaluation (1) Particle Size of Toner

The particle size of toner was obtained by measuring relative weight distribution of particle size by use of Coulter Counter TA-II type (made by Coulter Counter K.K.) equipped with aperture tube of 100 μm.

(2) Particle Size of Carrier

The particle size of carrier was measured by Micro Track Model 7995-10 SRA (made by Nikkiso K.K.) to obtain a mean particle size.

(3) Measurement of Charging Amount

Figure 2:
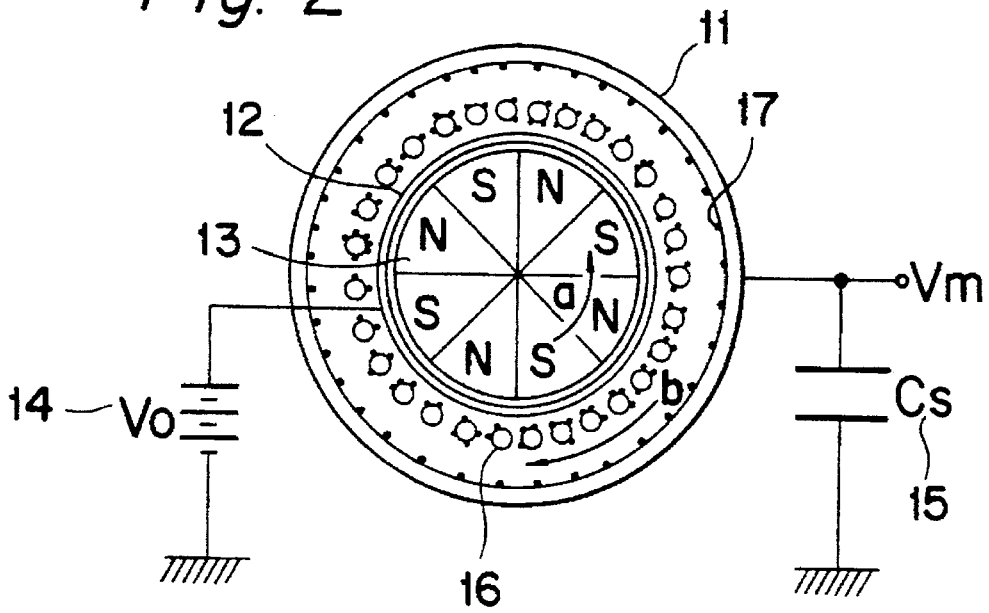
FIG. 2 represents a schematic sectional view of an apparatus for measuring a charging amount and a lowly charged toner amount.

A charging amount and a lowly charged toner amount were measured by use of an apparatus shown in FIG. 2 under the following conditions.

The number of revolution was set to 100 rpm, and as a developer, was employed the one prepared by stirring for 30 minutes. The developer of 1 g was weighed on a precision balance, and put uniformly on the entire surface of a conductive sleeve (12). Then bias voltage of 3 KV, which was opposite polarity to that of charged toner, was applied from a bias supply (14). The sleeve (12) was rotated for 30 seconds. After the sleeve (12) stopped, electrical potential Vm was read. In this step, the amount Mi of toner (17) attached to a cylindrical electrode (11) was weighed on the precision balance to calculate the average charge amount of toner.

(4) Measurement of Lowly Charged Toner Amount

In the measurement of charging amount, the bias voltage was not applied to the conductive sleeve (12). That is, the sleeve was earthed. Except for the above, the same procedure as that of measurement of charging amount was taken. Then an amount of toner transferred from the sleeve to the cylindrical electrode (11) was measured to obtain an amount of lowly charged toner.

(5) The Measurements of the above (1) and (2) were carried at 25° C. under 55 RH % atmosphere, or at 30° C. under 85 RH % atmosphere after the toners were left to stand under the same conditions overnight.

Evaluation of Copy Images

A toner shown in Table 1 and the carrier were mixed at a ratio (5/95) of toner/carrier to prepare two-component developers. In Examples 1, 4, 5 and 7 and Comparative Example 1, a copying machine EP-570Z (made by Minolta Camera K.K.) was used, in Examples 3 and 8, a copying machine EP-408Z (made by Minolta Camera K.K.) was used, and Examples 2 and 6, a copying machine CF-70 was used to make various evaluations shown in Table 1.

(1) Fogs on Copy Images

Copy images were formed by use of the developers. With respect to fogs on copy images, toner fogs formed on a white ground were evaluated to be ranked. A toner demonstrating the rank "Δ" or higher can be put into practical use. The preferable rank is "o".

(2) Durability Test with Respect to Copy

The developers were subjected to durability test with respect to 10000 times copy by use of a chart having a B/W ratio of 6% to evaluate copy images and fogs. The results were shown in Table 1.

Cleaning properties by a blade were evaluated at the same time.

The rank "o" in Table means that there is no problem with respect to practical use and "x" means that there are some problems with respect to practical use. A toner demonstrating the rank "Δ" or higher can be put into practical use. The preferable rank is "o".

In Example 3, durability with respect to copy was evaluated at an initial stage and after 1000 times of copy and 3000 times of copy.

(3) Light-Transmittability

In Examples 2 and 6, the test on light-transmittability was made. Light-transmittability was observed on the clearity of color with naked eyes when copy images formed on OHP sheet were projected by an OHP projector. The results were shown in Table 1. The rank "o" in Table means that the toner can be put into practical use with respect to color-reproducibility.

TABLE 1

| | toner | | | | | 25° C., 55 RH % | | 30° C., 85 RH % | |
|---|---|---|---|---|---|---|---|---|---|
| | toner | mean particle size (μm) | <3.14 μm (wt %) | >10.08 μm (wt %) | carrier | charged amount (μC/g) | amount of lowly charged toner (wt %) | charged amount (μC/g) | amount of lowly charged toner (wt %) |
| Example 1 | A | 6.3 | 2.1 | 0.2 | C | −18 | 0.8 | −17 | 1.0 |
| Example 2 | C | 6.3 | 3.2 | 0.1 | B | −20 | 0.8 | −18 | 1.2 |
| Example 3 | D | 6.3 | 4.3 | 0.8 | A | +16 | 1.8 | +15 | 2.0 |
| Example 4 | E | 6.1 | 3.1 | 0.1 | B | −17 | 0.4 | −16 | 0.8 |
| Comparative Example 1 | B | 6.2 | 9.3 | 3.8 | C | −17 | 17.5 | −11 | 48 |
| Example 5 | F | 6.2 | 2.8 | 0.5 | A | −1.6 | 1.3 | −15 | 1.8 |
| Example 6 | G | 6.3 | 3.2 | 0.1 | B | −20 | 0.8 | −18 | 1.2 |
| Example 7 | H | 6.2 | 3.8 | 0.3 | C | −16 | 1.5 | −15 | 2.2 |
| Example 8 | I | 6.3 | 2.3 | 0.3 | C | +19 | 0.3 | +18 | 0.5 |

| | initial | | 5000 sheets of copy paper | | 10000 sheets of copy paper | | |
|---|---|---|---|---|---|---|---|
| | fogs | cleaning properties | fogs | cleaning properties | fogs | cleaning properties | light transmittance |
| Example 1 | o | o | o | o | o | o | — |
| Example 2 | | | 1000 sheets | | 3000 sheets | | |
| | o | o | o | o | o | o | o |
| Example 3 | o | o | o | o | o | o | — |
| Example 4 | o | o | o | o | o | o | — |
| Comparative Example 1 | x | x | — | — | — | — | — |
| Example 5 | o | o | o | o | o | o | — |
| Example 6 | | | 1000 sheets | | 3000 sheets | | |
| | o | o | o | o | o | o | o |
| Example 7 | o | o | o | o | o | o | — |
| Example 8 | o | o | o | o | o | o | — |

What is claimed is:

1. A process for producing a toner for developing electrostatic latent images comprising steps of:

forming particles for toner containing a resin and a coloring agent in a wet process;

aggregating the particles;

mixing the aggregates with electrostatically chargeable fine resin-particles; and pulverizing the aggregates mixed with electrostatically chargeable fine resin-particles, thereby the electrostatically chargeable fine resin-particles being fixed on surfaces of particles produced due to pulverization.

2. A process according to claim 1, in which the electrostatically chargeable fine resin-particles are contained at a content of 0.01–30 parts by weight on the basis of 100 parts by weight of the particles for toner.

3. A process according to claim 1, in which the aggregates are mixed with inorganic fine particles selected from the group consisting of silica, titanium oxide, aluminum oxide and magnesium fluoride together with the electrostatically chargeable fine resin particles, and the resultant mixture is subjected to the pulverizing step.

4. A process according to claim 1, in which the pulverized particles are mixed with a kind of inorganic fine particles selected from the group consisting of silica, titanium oxide, aluminum oxide and magnesium fluoride.

5. A process according to claim 1, in which the particles are mixed with a kind of inorganic fine particles selected from the group consisting of silica, titanium oxide, aluminum oxide and magnesium fluoride, and then the resultant mixture is subjected to the aggregating step.

6. A process according to claim 1, which further comprises a step of drying the aggregates.

7. A process for producing a toner for developing electrostatic latent images comprising steps of:

forming particles for toner containing a resin and a coloring agent in a wet process;

mixing the particles with a kind of inorganic fine particles selected from the group consisting of silica, titanium oxide, aluminum oxide and magnesium fluoride;

aggregating the mixture;

mixing the aggregates with a charge controlling agent;

pulverizing the aggregates mixed with the charge controlling agent; and mixing the pulverized particles with a kind of inorganic fine particles selected from the group consisting of silica, titanium oxide, aluminum oxide and magnesium fluoride.

8. A process according to claim 7, in which the pulverizing step is carried out by the aggregates mixed with the charge controlling agent passing through a gap of 0.5–10 mm under dispersed conditions in an air-stream flowing at high speed, the gap being formed between rotating members or between a rotating member and a fixed member.

9. A process according to claim 7, in which the aggregates are mixed with a kind of inorganic fine particles selected from the group consisting of silica, titanium oxide, aluminum oxide and magnesium fluoride, and then the resultant mixture is subjected to the pulverizing step.

10. A process according to claim 7, which further comprises a step of drying the aggregates.

11. A process for producing a toner for developing electrostatic latent images comprising:

forming particles for toner containing a resin and a coloring agent in a wet process;

aggregating the particles;

mixing the aggregates with organic fine particles or inorganic fine particles having a mean particle size of one-fifth of that of the particles formed in a wet process or less; and pulverizing the mixed aggregates by passing the aggregates through a gap of 0.5–10 mm under dispersed conditions in an air-stream flowing at a high speed, the gap being formed between rotating members or between a rotating member and a fixed member.

12. A process according to claim 11, in which the aggregates are mixed with a kind of inorganic fine particles selected from the group consisting of silica, titanium oxide, aluminum oxide and magnesium fluoride, and then the resultant mixture is subjected to the pulverizing step.

* * * * *